US006786443B2

(12) United States Patent
Trutschel

(10) Patent No.: US 6,786,443 B2
(45) Date of Patent: Sep. 7, 2004

(54) EXPANDING MANDREL

(75) Inventor: Hartwig Horst Trutschel, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 36 days.

(21) Appl. No.: 10/362,969

(22) PCT Filed: Sep. 7, 2001

(86) PCT No.: PCT/DE01/03443

§ 371 (c)(1),
(2), (4) Date: Mar. 6, 2003

(87) PCT Pub. No.: WO02/24563

PCT Pub. Date: Mar. 28, 2002

(65) Prior Publication Data

US 2004/0094655 A1 May 20, 2004

(30) Foreign Application Priority Data

Sep. 19, 2000 (DE) ..... 100 46 164

(51) Int. Cl.[7] ..... B65H 19/30; B65H 75/24
(52) U.S. Cl. ..... 242/533.7; 242/573.7
(58) Field of Search ..... 242/533.7, 473.9, 242/559, 573.4, 573.7, 573.9, 571, 576.1

(56) References Cited

U.S. PATENT DOCUMENTS

| | | | | |
|---|---|---|---|---|
| 2,826,376 A | | 3/1958 | Wallin | |
| 4,149,682 A | | 4/1979 | Gustafson et al. | |
| 4,211,375 A | | 7/1980 | Weiss et al. | |
| 4,484,716 A | * | 11/1984 | Korcusko et al. | 242/533.7 |
| 4,715,553 A | | 12/1987 | Hatakeyama et al. | |
| 4,917,320 A | * | 4/1990 | Lauener et al. | 242/533.7 |
| 4,951,894 A | | 8/1990 | Young, Jr. et al. | |
| 5,531,398 A | | 7/1996 | Krska | |
| 6,027,063 A | | 2/2000 | Jaschke | |
| 6,047,915 A | | 4/2000 | Jaschke | |

FOREIGN PATENT DOCUMENTS

| | | |
|---|---|---|
| DE | 28 14 338 | 10/1979 |
| DE | 29 48 753 | 6/1980 |
| DE | 35 36 177 C1 | 4/1987 |
| JP | 53-051371 A | 5/1978 |
| WO | WO 98/28218 | 7/1998 |

* cited by examiner

*Primary Examiner*—John M. Jillions
(74) *Attorney, Agent, or Firm*—Jones Tullar & Cooper, P.C.

(57) ABSTRACT

An expanding mandrel is useable for rotatably mounting a strip of material that is wound around a sleeve or core. The expanding mandrel includes an ejecting device that is useable to strip the sleeve or core from the mandrel. The ejecting device includes at least a first part, which is rotatable about an axis together with the sleeve or core, and a non-rotatably mounted second part. The first part can strip the sleeve or core from the mandrel by actuation of the second part. That second part is a piston which can be driven by a fluid under pressure.

10 Claims, 2 Drawing Sheets

EXPANDING MANDREL

FIELD OF THE INVENTION

The present invention is directed to a clamping mandrel for the rotatable support of a web wound on a tube.

BACKGROUND OF THE INVENTION

Clamping mandrels usable for the rotatable support of paper rolls, such as are used in connection with web-fed rotary printing presses, are known from U.S. Pat. No. 4,149,682, U.S. Pat. No. 4,951,894 and U.S. Pat. No. 4,715,553. Ejecting devices are provided on the clamping mandrels, by use of which the tube on which the paper web is wound can be stripped off the clamping mandrels. Spring elements, that are provided on the ejecting device, are elastically prestressed in the course of inserting the clamping mandrel into the tube. When the clamping mandrel is pulled back out of the tube for changing the paper web, the prestress of the spring elements assures that the tube is stripped off the two oppositely located clamping mandrels.

The disadvantage of this type of structure of an ejecting device lies in that the force, by which the tube can be stripped off the clamping mandrel, is limited by the type of construction of the spring elements. It is moreover necessary to overcome the prestress of the spring elements in the course of inserting the clamping mandrels into the tube.

A clamping mandrel is known from DE 28 14 338 A1, in which a displaceable ring, which can rotate together with the mandrel, is arranged between the detent flange of the mandrel and the tube. An actuating device, which is fixed in place on a frame, is provided for ejecting the tube. Claws are provided on the actuating device, wherein the ring can freely rotate in one position of the claws, namely the position of rest, and is not in engagement with the claws. In the course of operating the actuating device the claws are pressed against the ring, so that the tube can be stripped off the clamping mandrel.

It is disadvantageous in connection with the actuating device known from DE 28 14 338 A1 that, because of its mechanical drive mechanism, the ejecting device requires a large structural volume.

DE 35 36 1777 C1, DE 29 48 753 A1, U.S. Pat. No. 2,826,376 and JP 53-051 371 A describe devices for receiving a wound roll.

SUMMARY OF THE INVENTION

It is the object of the present invention to provide a clamping mandrel.

In accordance with the present invention, the object is attained by providing a clamping mandrel for the rotatable support of a web which is wound on a tube. An ejecting device is usable to strip the tube off the mandrel. The ejecting device includes at least.

The advantages which can be achieved by the present invention lie, in particular, in that a pressure-charged piston is employed for driving the ejecting arrangement. Since the pressure-containing fluid, which may be, for example, compressed air or hydraulic fluid, can be conducted to the piston head above the piston through conduits, whose geometry can be arbitrarily designed, clamping mandrels of very compact design are possible. It is furthermore possible to generate very high stripping forces by selecting a correspondingly high working pressure.

To reduce the technical outlay, in the course of constructing the clamping mandrel, it is advantageous if the piston for stripping off the tube is driven by use of the fluid. Elastic spring elements, for example helical springs, can be used for restoring the piston into the initial position.

Since the ejecting arrangement has an element, which can be rotated along with the clamping mandrel, and a fixed element, which two elements must be brought into engagement with each other, there is the danger that increased wear may occur in the area of contact between the rotatably seated element and the stationary element of the ejecting arrangement. Therefore, the embodiment of the ejecting arrangement is to be selected so that the second element can be switched between a position of rest and at least one working position. In the position of rest, the first element is completely separated from the second element by a gap, while in the working position the first element comes to rest against the second element, so that forces for actuating the second element can be transmitted.

Magnetic elements can be particularly advantageously employed for restoring the second element out of at least one working position. The attracting forces, emanating from a magnetic element, act in a contactless manner over an air gap, and in this way they can automatically retract the stationary second element, for example an actuating piston, in a particularly simple manner.

In general it is advantageous, in connection with devices which have a rotatably supported and axially actuable adjusting element, which adjusting element can be displaced by an axially displaceable, fluid-driven piston between a position of rest and at least one working position, if the axially displaceable, fluid driven piston can be returned from its working position into its position of rest by use of at least one magnetic element. It is possible, in this way, to prevent wear in the contact zone between the fixed piston and the rotatably supported seated adjusting element in a simple way. As long as it is not needed, the piston is automatically retracted, in a simple manner, by the magnetic element and is dependably maintained in its retracted position .

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
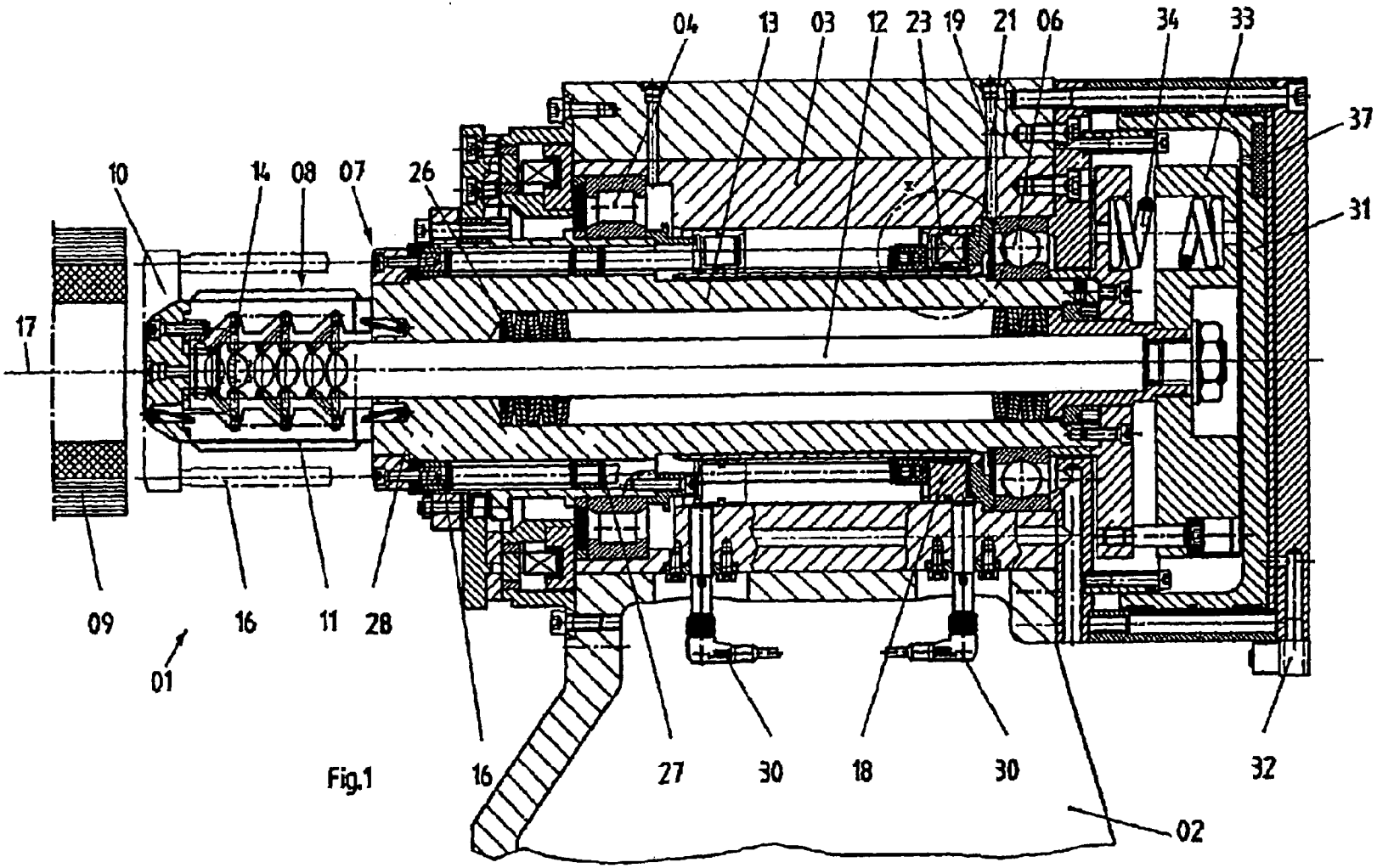
FIG. 1, a cross-sectional, side elevation view of a clamping mandrel in accordance with the present invention, FIG. 2, a detail view taken at X in FIG. 1 and showing the clamping mandrel in a first operating state, and in FIG. 3, a detail view taken at X in FIG. 1 and showing the clamping mandrel in a second operating state.

A clamping mandrel 01 in accordance with the present invention is represented in FIG. 1. Clamping mandrel 01 is fastened in a frame 02, shown in a broken-off manner, of a roll changer, which is not further represented. A multi-part shaft 07 is rotatably supported in rolling bearings 04, 06 in the housing 03 of the clamping mandrel 01, which housing 03 is fixedly connected with the frame 02.

On the left side of the housing 03, as seen in FIG. 1, the multi-part shaft 07 extends to the outside of the housing 03 and constitutes a clamping cylinder 08, on which a schematically represented tube 09 can be fixed in place. To fix the tube 09 in place on the clamping mandrel 01, toggle levers, located at clamping cheeks 11 of the clamping cylinder 08, are pushed radially outward by the use of plate springs and compression springs. An adjusting element 12 of the multipart shaft 07, for example an actuating shaft 12, can be axially displaced in a hollow shaft 13 of the multipart shaft 07 for actuating the clamping cheeks 11, so that the clamping cheeks 11 are pushed radially outward by positive engagement with spreading elements 14 which are carried at the left or outboard end of the actuating shaft 12.

The tube 09, which is engaged by the clamping cylinder 08 supports a rolled-up web, such as, for example a paper web.

For stripping an empty or used tube 09 off the clamping cylinder 08, a stripping ring 10 of the clamping cylinder 08, including an ejecting arrangement with several actuating elements 16, for example rotatable elements 16, for example ejecting. bolts 16, is provided. In this case, the ejecting bolts 16 are arranged in such a way on a hollow shaft 13, which is part of the multipart shaft 07, so that the one end of the stripping ring 10 can come to rest against the front or end face of the tube 09. To accomplish the removal of the tube 09 from the clamping cylinder 08, the ejecting bolts 16 are synchronously moved axially out, together with the stripping ring 10, from the free end of the multipart shaft 07. In the course of this movement, they push the tube 09 axially off the clamping cylinder 08. Care should be taken that the ejecting bolts 16 and the stripping ring 10 are seated to be axially displaceable on the hollow shaft 13 and, together with the hollow shaft 13, rotate in the housing 03 around the center axis 17.

A non-rotatable element, for example a ring-shaped piston 18, which can be charged with a pressure medium via a pressure line 19, is used for actuating the ejecting bolts 16. The functioning of the actuation of the ejecting bolts 16 by use of the piston 18 will be explained by utilization of FIGS. 2 and 3, which represent the detail X in FIG. 1 in an enlarged manner.

Figure 2:
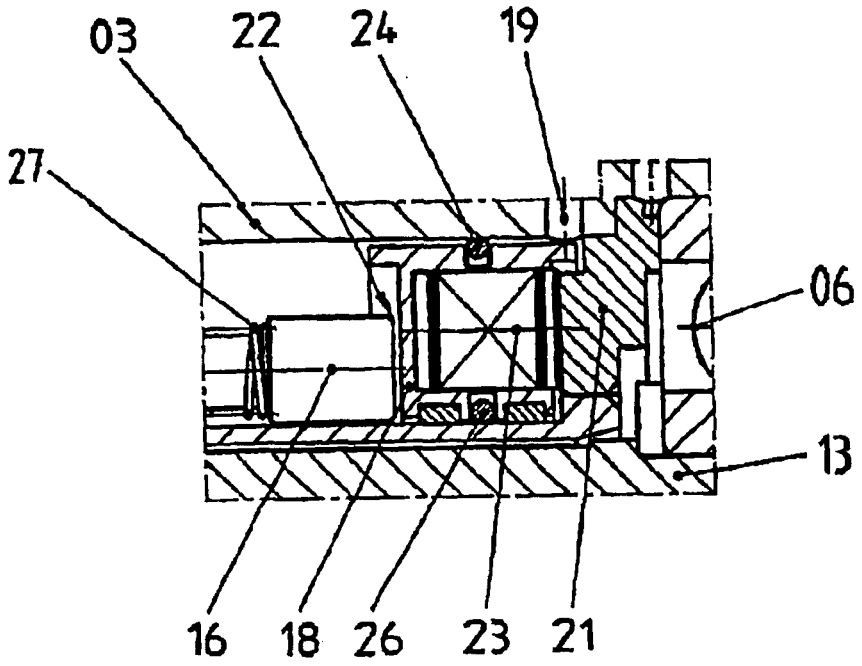

The piston 18 and the right end of the ejecting bolt 16 can be seen in cross section in FIG. 2. In connection with the operation of the ejecting bolt 16, it should be noted that the piston 18, together with the housing 03, an intermediate element 21 and the outer ring of the rolling bearing 06, are fixed In place in relation to the frame 02, while the ejecting bolt 16, together with the hollow shaft 13, can rotate around the center axis 17 of the clamping mandrel 01. The ring-shaped piston 18 can be sealed by simple seals or seal rings 24, 26 , which are structured in the manner of piston rings.

The piston 18 is shown in its position of rest in FIG. 2, in which rest position of piston 18 the ejecting bolt 16 and the piston 18 are separated by a gap 22. In the position of rest of the piston 18, the ejecting bolts 16 can rotate, free of wear and resistance, around the center axis 17. Magnetic elements 23, for example permanent magnets 23, are fastened to the front or end face of the piston 18 which is facing away from, or remote from the ejecting bolts 16. These magnetic elements 23 pull the piston 18 against the metallic intermediate element 21 and in this way assure that the piston 18 is dependably maintained in its position of rest. The piston 18 is sealed against the housing 03, or the intermediate element 21, by operation of the seal rings 24, 26. It is thus possible to exert a force directed in the direction of the ejecting bolt 16 by charging the pressure line 19 with a pressure medium so as to move the ring-shaped piston 18 to the left, as shown in FIG. 3.

Figure 3:
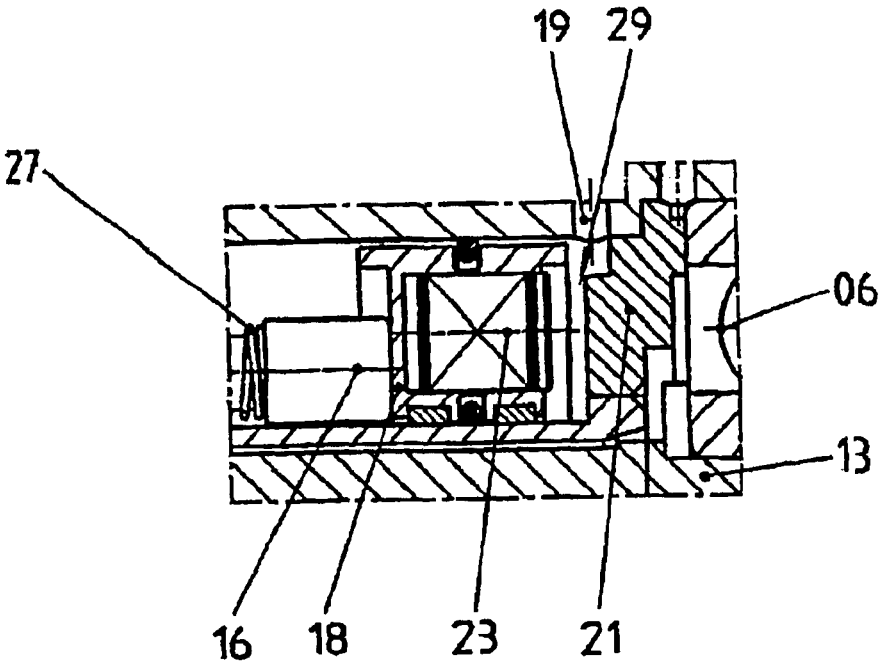

In FIG. 3 the piston 18 is represented in its working position. By supplying pressure medium through the pressure line 19, the piston 18 is pushed against the ejecting bolt 16, so that the ejecting bolts 16 and the stripper ring 10 move out to the left, as shown in dashed lines in FIG. 1 to strip the tube 09 off the clamping cylinder 08. As soon as the tube 09 has been stripped off, the pressure medium is drained from the pressure line 19, so that no pressure forces will now act on the piston 18.

Springs 27, for example helical springs 27, are provided on each of the ejecting bolts 16, which helical springs 27 prestress the ejecting bolts 16 against the hollow shaft 13, A restoring force which, following the draining of the pressure medium out of the pressure line 19, assures that the ejecting bolts 16 are again automatically retracted, acts on the ejecting bolts 16 because of the prestress by the helical springs 27. The piston 18 is also pushed back together with the ejecting bolts 16 until the ejecting bolts 16 come into contact with appropriately provided end stops 28, as shown in FIG. 1. In this rearmost working position, in which the piston 18 still rests against the ejecting bolt 16, a gap 29 exists between the piston 18 and the intermediate element 21, which gap 29 must be bridged to return the piston 18 out of its rearmost working position and into a position of rest. By operation of the permanent magnets 23 provided on the piston 18, a magnetic force, which is directed toward the right as seen in FIGS. 2 and 3, acts on the piston 18, which magnetic force causes the return of the piston 18 across the gap 29. At the termination of the actuation of the ejecting bolts 16, the piston 18 again takes up its position of rest as represented in FIG. 2, where it is separated from the ejecting bolts 16 by the gap 22.

For actuating the rotatably seated, axially shiftable ejecting bolts 16, it is merely necessary to employ the displaceably seated piston 18. Accordingly, the sealing of the work chamber above the piston 18 is greatly simplified. The walls of the piston 18 constituting the sealing gap, on the one hand, and of the housing 03, or of the intermediate elements 21, on the other hand, do not perform any rotationally directed relative movement.

The end positions of the piston 18 are detected and determined by sensors.

The employment of magnetic elements for uncoupling of a pair of elements can be utilized, for example, also in the actuating device of the clamping cheeks 11. It can be seen in FIG. 1 that the actuator shaft 12, which represents such a rotatably seated actuating element, can be displaced toward the left by operation of an axially displaceable, non rotating piston 31 for actuating the clamping cheeks 11. For this purpose, a pressure medium is supplied via a pressure line 32 to a cylinder chamber formed by the piston 31 and the housing 03. The pressure medium assures that the piston 31 is displaced toward the left and in this way displaces the actuator shaft 12 by acting on the front plate 33, so that as a result the clamping cheeks 11 can be actuated.

Following the draining of pressure medium from the pressure line 32, coil springs 34 assure the return of the actuator shaft 12, so that the piston 31 is pushed back by the front plate 33. The return of the actuator shaft 12 is limited by end stops, so that the front plate 33 can push the piston 31 back only up to a defined point, namely the rearmost working position. In this position, the piston 31 still rests against the front plate 33, which is undesirable because of wear occurring in case of a relative movement between the front plate 33 and the piston 31. To prevent this wear, magnetic elements 37, for example a permanent magnet 37, are provided on the front face of the piston 31 facing away from the front plate 33, by use of whose magnetic forces the piston 31 can be returned into a position of rest, in which the piston 31 no longer rests against the front plate 33.

While a preferred embodiment of an expanding mandrel in accordance with the present invention has been set forth fully and completely hereinabove, it will be apparent to one of skill in the art that various changes in, for example the overall size of the device, the specific type of working fluid and the like could be made without departing from the true spirit and scope of the present invention which is accordingly to be limited by the following claims.

What is claimed is:

1. A clamping mandrel adapted to rotatably support a web wound on a tube, said clamping mandrel comprising:

an ejecting device usable to strip a tube off the mandrel;

a first element in said ejecting device, said first element being rotatable about a central axis of rotation of the tube, said first element being adapted to strip the tube off the mandrel; and a second element in said ejecting device, said second element being adapted to engage said first element, said second element being a fluid actuated piston said piston being movable between a working position in which the tube is stripped off the mandrel, and a rest position in which said piston is separated by a gap from said first element.

2. The clamping mandrel of claim 1 further including at least one elastic element usable to move said piston from said working position to said rest position.

3. The clamping mandrel of claim 2 wherein said elastic element is a spring.

4. The clamping mandrel of claim 1 further including a magnetic element usable to return said piston to said position of rest.

5. The clamping mandrel of claim 4 wherein said magnetic element is fastened on said piston.

6. The clamping mandrel of claim 5 wherein said magnetic element is a permanent magnet.

7. A clamping mandrel adapted to rotatably support a web wound on a tube, said clamping mandrel comprising;

an ejecting device usable to strip a tube off the mandrel;

a first element in said ejecting device, said first element being rotatable about a central axis of rotation of the tube, said first element being adapted to strip the tube off the mandrel;

a second element in said ejecting device, said second element being adapted to engage said first element, said second element being a fluid actuated ring-shaped piston; and a clamping cylinder, said piston being arranged coaxially in respect to said clamping cylinder of said clamping mandrel.

8. The clamping mandrel of claim 7 wherein said piston is movable between a working position and a rest position and further including a magnetic element usable to return said piston to said rest position from said working position.

9. The clamping mandrel of claim 8 wherein said magnetic element is fastened on said piston.

10. The clamping mandrel of claim 9 wherein said magnetic element is a permanent magnet.

* * * * *